US007908839B2

(12) United States Patent
Fink et al.

(10) Patent No.: US 7,908,839 B2
(45) Date of Patent: Mar. 22, 2011

(54) TWO-FOR-ONE TWISTING SPINDLE HAVING A PNEUMATICALLY ACTUATED THREADING DEVICE

(75) Inventors: Heinz Fink, Krefeld (DE); Georg Tetzlaff, Aachen (DE); Sergi Singer, Krefeld (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 98 days.

(21) Appl. No.: 12/308,826

(22) PCT Filed: May 18, 2007

(86) PCT No.: PCT/EP2007/004446

§ 371 (c)(1),
(2), (4) Date: May 7, 2009

(87) PCT Pub. No.: WO2007/147468

PCT Pub. Date: Dec. 27, 2007

(65) Prior Publication Data

US 2010/0018178 A1 Jan. 28, 2010

(30) Foreign Application Priority Data

Jun. 24, 2006 (DE) ..... 10 2006 029 055

(51) Int. Cl.
*D01H 1/10* (2006.01)

(52) U.S. Cl. ..... 57/58.49; 57/261

(58) Field of Classification Search ..... 57/58.49, 57/58.7, 58.83, 261
See application file for complete search history.

(56) References Cited

U.S. PATENT DOCUMENTS

| | | | | |
|---|---|---|---|---|
| 4,328,663 | A * | 5/1982 | Kallmann | 57/279 |
| 6,425,236 | B1 * | 7/2002 | Roquet et al. | 57/58.49 |
| 7,467,508 | B2 * | 12/2008 | Fink et al. | 57/58.7 |
| 2008/0047250 | A1 | 2/2008 | Fink et al. | 57/279 |

FOREIGN PATENT DOCUMENTS

| | | | |
|---|---|---|---|
| DE | 30 12 427 | A1 | 4/1981 |
| DE | 102 50 423 | A1 | 5/2004 |
| DE | 10 2004 050 180 | A1 | 4/2006 |
| EP | 0 795 634 | A2 | 9/1997 |
| EP | 1 416 073 | A2 | 5/2004 |

* cited by examiner

*Primary Examiner* — Shaun R Hurley
(74) *Attorney, Agent, or Firm* — K&L Gates LLP

(57) ABSTRACT

Two-for-one twisting spindle having a pneumatically actuated threading device, with a spindle shaft rotatable about a vertical axis partially configured as a hollow shaft with a lower feed bore extending coaxially to the rotational axis, and with an injector element opening into a thread guide channel of a thread guide ring temporarily connectable during threading to a compressed air source. Part of the compressed air feed to the injector element is formed by the feed bore. The compressed air feed comprises a connection element (27) with a curved air channel (26), which connects the feed bore (24) to the injector element (16). The connection element (27) is configured as a separate component and the air channel (26) is adapted to the flow requirements.

11 Claims, 3 Drawing Sheets

TWO-FOR-ONE TWISTING SPINDLE HAVING A PNEUMATICALLY ACTUATED THREADING DEVICE

CROSS-REFERENCES TO RELATED APPLICATIONS

This application claims the benefit of German patent application 10 2006 029 055.0, filed Jun. 24, 2006, herein incorporated by reference.

BACKGROUND OF THE INVENTION

The invention relates to a two-for-one twisting spindle having a pneumatically actuated threading device.

In two-for-one twisting spindles, the thread is generally drawn off upwardly from the stationary supply bobbin, introduced into the upper end of a thread inlet tube, deflected downwardly and guided by a thread brake into the spindle rotor or into the spindle shaft, which it leaves again in the radial direction through a thread guide channel.

After leaving the thread guide channel, the thread is guided upwardly and, during the twisting, forms a balloon rotating about the supply bobbin. The thread then runs through a thread guide and is wound, twisted, onto a take-up bobbin.

On modern two-for-one twisting machines, the threading of the thread takes place by means of compressed air and a threading injector. Compressed air is fed to the threading injector for the threading process. The air flowing out of the threading injector produces in the thread guide channel an air flow directed outwardly to the mouth of the thread guide channel. A negative pressure is produced in the part of the spindle shaft configured as a hollow spindle. The sucked-in air draws the already held thread into the mouth at the upper end of the thread inlet tube. The air flow conveys the thread outwardly through the thread guide channel. After leaving the thread guide channel, the thread can be grasped manually by the operator and drawn off from the supply bobbin and positioned for further processing steps.

German Patent Publication DE 3012427 C2 discloses a two-for-one twisting spindle having a pneumatically actuated threading device, in which the spindle rotor has a coaxially extending connection channel, through which compressed air is fed. In the storage disc of the spindle rotor, the thread channel feeding thread from above and the connection channel feeding the compressed air from below in each case open, after a deflection, into the thread guide channel of the storage disc. The compressed air entering the connection channel during the threading process flows through the injector and produces the suction action required to suck in the thread in the hollow spindle in the upper part of the spindle rotor. On ending the threading process, the compressed air feed is interrupted again.

German Patent Publication DE 10250423 A1 shows a two-for-one twisting spindle having a pneumatically actuated threading device, in which the compressed air channel in the lower part of the spindle shaft is firstly guided centrally and, before reaching the thread storage disc, is guided as an oblique bore. Adjoining the compressed air channel in the spindle shaft is an air channel in an injector element which opens as an injector into the thread channel and therein produces the required air flow radially outwardly.

The production costs of these known embodiments are high. In particular, the manufacturing of the channels in the spindle shaft is expensive. The efficiency of the known designs is unsatisfactorily low. A measure of the efficiency in this case is the static or dynamic negative pressure which can be produced in the thread inlet tube or in the thread channel as a function of the pressure of the pressure source used. The lower the pressure of the compressed air source for achieving an adequately high negative pressure for sucking in the thread, the more economically or efficiently the threading process can be carried out. The configuration of the air guide in the known embodiments to the thread channel limits the efficiency.

In addition, the abrupt deflection of the air flow through around 90° or more leads to the fact that the compressed air leaving the compressed air channel firstly impinges perpendicularly on the wall of the injector element before the compressed air flow is deflected and accelerated in the injector element. The swirlings occurring at the deflection point reduce the efficiency of the injector element as the compressed air must be fed at a higher pressure to compensate this effect.

SUMILLIMETERSARY OF THE INVENTION

The object of the invention is to develop a known two-for-one twisting spindle in such a way that the quantity of fed compressed air can be reduced at the same or higher produced negative pressure.

This object is achieved by means of a two-for-one twisting spindle wherein, according to the invention, the compressed air feed comprises a connection element with a curved air channel, which connects the feed bore to the injector element, and wherein the connection element is configured as a separate component and the air channel is adapted to the flow requirements. In contrast to the prior art, in which the compressed air feed and the injector element connected thereto offer few design possibilities for improving the flow behavior, the connection element designed as a separate component has the substantial advantage that it can easily be designed in a manner which is optimised in terms of flow in order to contribute to the optimisation of the pneumatically actuated threading device. In addition, production is possible in a simple and economical manner. The inventive configuration of the compressed air feed in terms of flow increases the injector effect. The pressure of the compressed air source can be lowered in comparison to known devices, without the negative pressure produced for sucking in the thread being reduced. Alternatively, the negative pressure is increased with the same pressure of the compressed air source, so the suction effect on the thread is increased. Moreover a calming of the compressed air entering the air channel of the connection element is achieved in that swirlings of the compressed air occurring while flowing through the air channel, which occur after the abrupt deflection during the exit from the feed bore into the connection element, are reduced. This effect also contributes to it being possible to reduce the air pressure of the fed compressed air without reducing the efficiency of carrying out the threading process. Overall, the injector effect in the injector element is improved with a pressure which is reduced compared to the prior art and this increases the economic efficiency of the two-for-one twisting spindle with a pneumatically actuated threading device.

Advantageous configurations of the connection element contribute to the feeding of the compressed air, which is particularly favourable in terms of flow, to the injector element and increase the effect of the injector element.

In an air channel, which has a larger cross section at its inlet than at its outlet, the flow speed of the air is increased. As a result, the injector jet, which is formed by the air exiting into the thread guide channel, is pre-reinforced.

The spindle shaft and the thread guide ring preferably have recesses, into which the connection element can be inserted. The angle position of the thread guide ring on the spindle shaft can be adjusted and fixed by the inserted connection element. If the thread guide ring with its recess has been slipped over the connection element, the thread guide channel and the outlet of the injector element are aligned with one another. It is not possible to rotate the spindle shaft and thread guide ring with respect to one another in the assembled state as the inserted connection element acts as an anti-rotation mechanism.

A connection element, which is comprised of two components rigidly connected to one another, which are mirror-inverted with respect to one another, is simple to produce and less expensive in comparison to a connection element produced in one piece.

If the connection element is comprised of glass fiber-reinforced plastics material, it can be produced economically, has only a low weight and is durable.

A sealing ring between the connection element and the spindle shaft and between the connection element and the injector element, in each case, represents an economical and functionally reliable seal of the compressed air feed.

The configuration of the connection element as a separate component allows easy production and adaptation of the air channel to the flow requirements. This contributes to it being possible to economically produce a two-for-one twisting spindle according to the invention. The economy during the threading process is improved by low compressed air consumption, which is possible because of the increased injector effect.

BRIEF DESCRIPTION OF THE DRAWINGS

An embodiment of the invention will be described with the aid of the figures, in which.

DETAILED DESCRIPTION OF THE PREFERRED EMBODIMENTS

Figure 1:
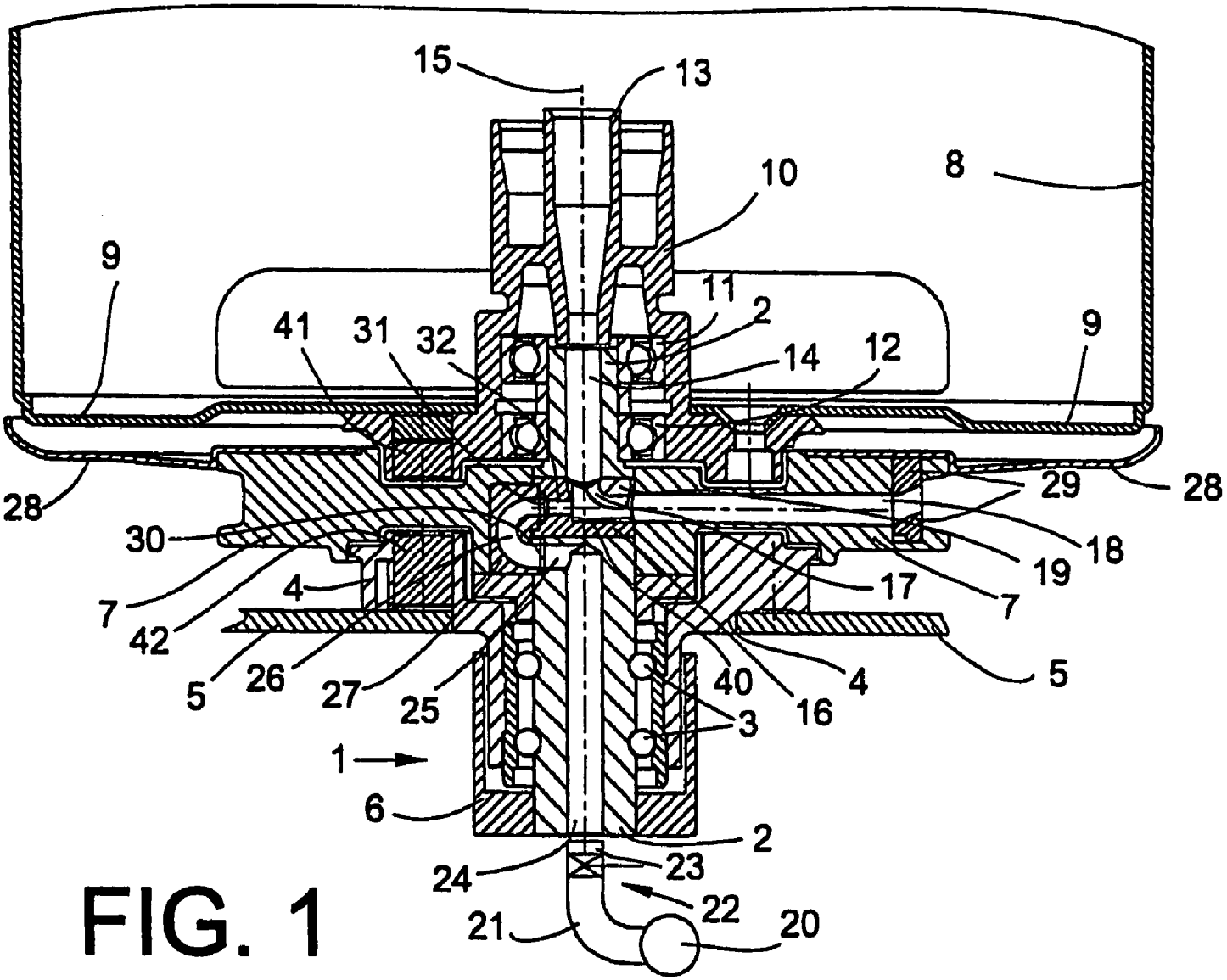
FIG. 1 shows a partial view of a two-for-one twisting spindle with a pneumatically actuated threading device in an axial section.

FIG. 1 shows a two-for-one twisting spindle with a spindle bearing arrangement 1. The spindle shaft 2 configured in one piece is rotatably mounted in the bearing housing 4 by means of a ball bearing arrangement 3. The bearing housing 4 is fastened to the spindle rail 5. The spindle shaft 2 carries a drive wharve 6, a thread guide ring 7 and a bobbin pot 8 with a bobbin carrier base 9 and hollow hub 10. The hollow hub 10 is mounted by means of ball bearings 11, 12 on the spindle shaft 2 and has a coaxially thread tube 13. The thread tube 13 opens into the upper hollow axle 14 of the spindle shaft 2. The spindle shaft 2 can be rotated about the perpendicularly extending rotational axis 15. A recess passing through the spindle shaft 2, with an oval cross section, extends transversely to the rotational axis 15. An injector element 16 made of plastics material is inserted into the recess. It can be produced as an injection moulded part, economically and so as to fit precisely, corresponding to the flow requirements. The thread channel 17 of the injector element 16 connects the upper hollow axle 14 of the spindle shaft 2 to the thread guide channel 18 of the thread guide ring 7. The air flow during threading as well as the thread are deflected in the thread channel 17. The thread in this case runs via a deflection element 19 made of ceramic. The thread guide channel 18 of the thread guide ring 7 extending horizontally and therefore at right angles to the rotational axis 15 of the spindle shaft 2, at its outer end, has a thread guide 29 made of ceramic. The thread guide ring 7 carries the rotary plate 28. The bobbin carrier base 9 can be rotated relative to the spindle shaft 2 and is held, when the spindle shaft 2 rotates, in its position with respect to the bearing housing 4 or to the spindle rail 5 by means of the magnetic force of permanent magnets 41, 42 with magnetic returns.

The injector element 16 can be connected temporarily to a compressed air source 20. The air flow in the compressed air line 21 can be interrupted by means of a shut-off mechanism 22. The tube mouth 23 of the compressed air line 21 leading from the compressed air source 20 to the spindle shaft 2 is arranged stationarily below the spindle shaft 2. A stationarily arranged compressed air feed of this type to the spindle shaft 2 is described in detail, for example, in German Patent Publication DE 3012427 C2. The compressed air line 21 ends at a slight spacing from the feed bore 24 of the spindle shaft 2. In this configuration, seals between the tube mouth 23 and the spindle shaft 2 can be dispensed with. Compressed air losses are largely avoided. The compressed air is firstly guided to the spindle shaft 2 in the feed bore 24 extending coaxially to the rotational axis 15. The feed bore 24 opens into a transverse bore 25. The transverse bore 25 is connected to the injector element 16 by means of the channel 26 of the of the connection element 27. The air channel 26 extends in a semi-circular manner. The centre line 37 of the air channel 26 and the rotational axis 15 of the spindle shaft 2 lie in one plane. The semi-circle, which is formed by the centre line 37, has a radius of between 3 millimeters and 6 millimeters.

Figure 2:
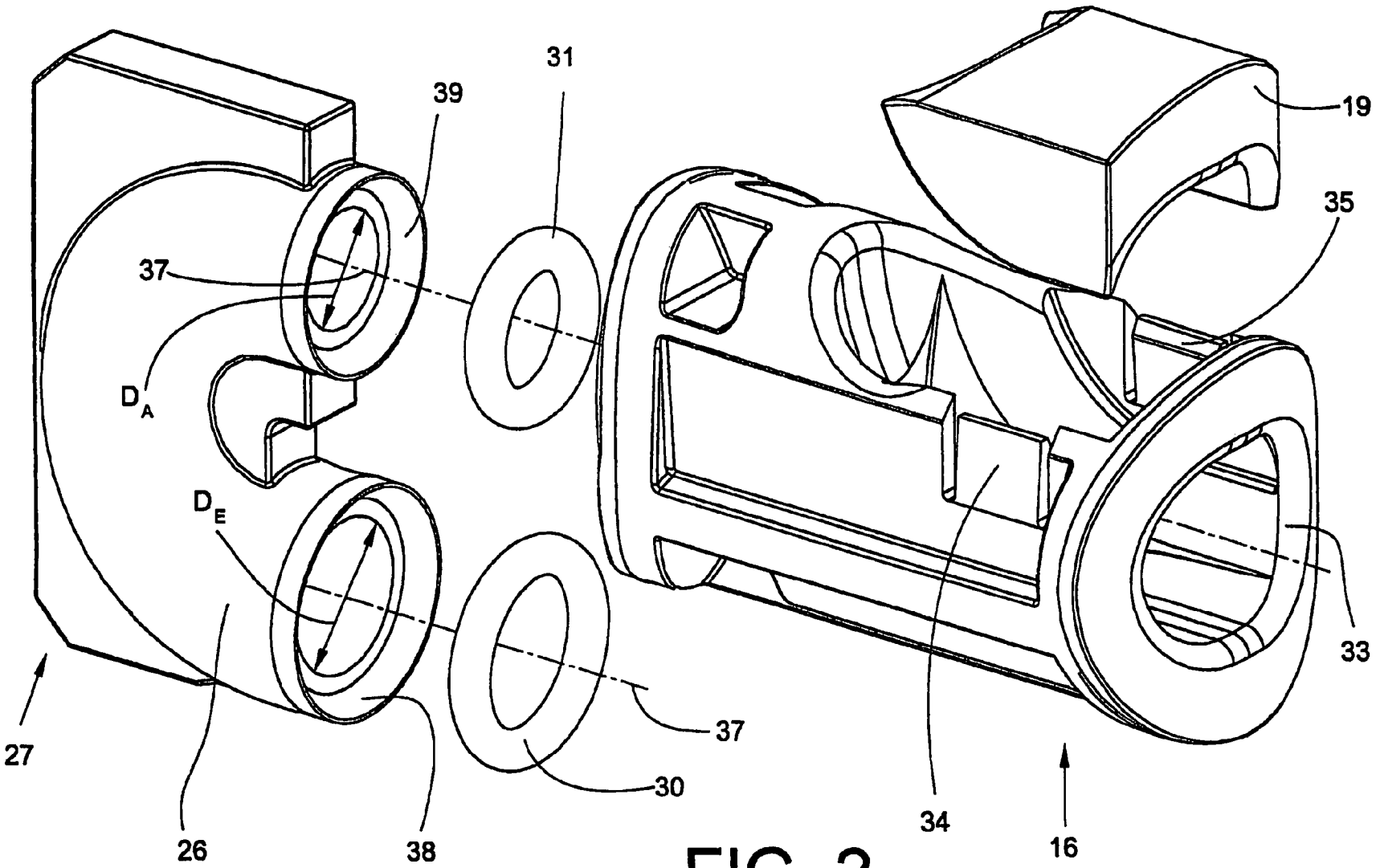
FIG. 2 shows a perspective view of a disassembled connection element with sealing rings as well as an injector element with a deflection piece.

FIG. 2 shows the connection element 27 and the injector element 16 in the unassembled state. The air channel 26 extends substantially semi-circularly. The deflection in the connection element 27 is 180°. The air channel 26 has a circular cross section and, at its inlet, has a larger cross section than at its outlet which, in the assembled state, rests on the injector element 16. Accordingly, the air channel diameter $D_E$ at the inlet of the air channel 26 is greater than the air channel diameter $D_A$ at the outlet of the air channel 26. The connection element 27 is configured to receive sealing rings 30, 31 both at the inlet and at the outlet of the air channel 26. In the installed state of the connection element 27, the sealing rings 30, 31 are pressed together and lead to a secure seal between the connection element 27 and the spindle shaft 2 and between the connection element 27 and the injector element 16. The injector element 16 comprises an injector bore 32, which opens into the thread channel 17 and which is directed onto the thread guide channel 18. The injector bore 32 and the thread guide channel 18 are arranged so as to be aligned. The diameter of the injector bore 32 is significantly smaller than the diameter of the thread channel 17. Consequently a step 40, as shown in FIG. 1, is produced. The air leaving the injector bore 32 as an injector jet can flow freely in the direction of the thread guide channel 18. The injector bore 32 which runs in a straight line has a constant diameter. An injector bore 32 of this type with a length between 5 millimeters and 6 millimeters allows the injector jet to be made uniform.

The thread channel mouth 33 is adapted to the circular shape of the cross section of the spindle shaft 2 and opens directly into the thread guide channel 18. The deflection element 19, which is exposed to the friction from the running thread, is pressed into the injector element 16 and held by the resilient holding flaps 34, 35. The deflection element 19, in the installed state, forms the upper wall of the thread channel 17, as shown in FIG. 1. While the injector element 16 is produced from plastics material, the deflection element is comprised of highly wear-resistant ceramic.

Figure 3:
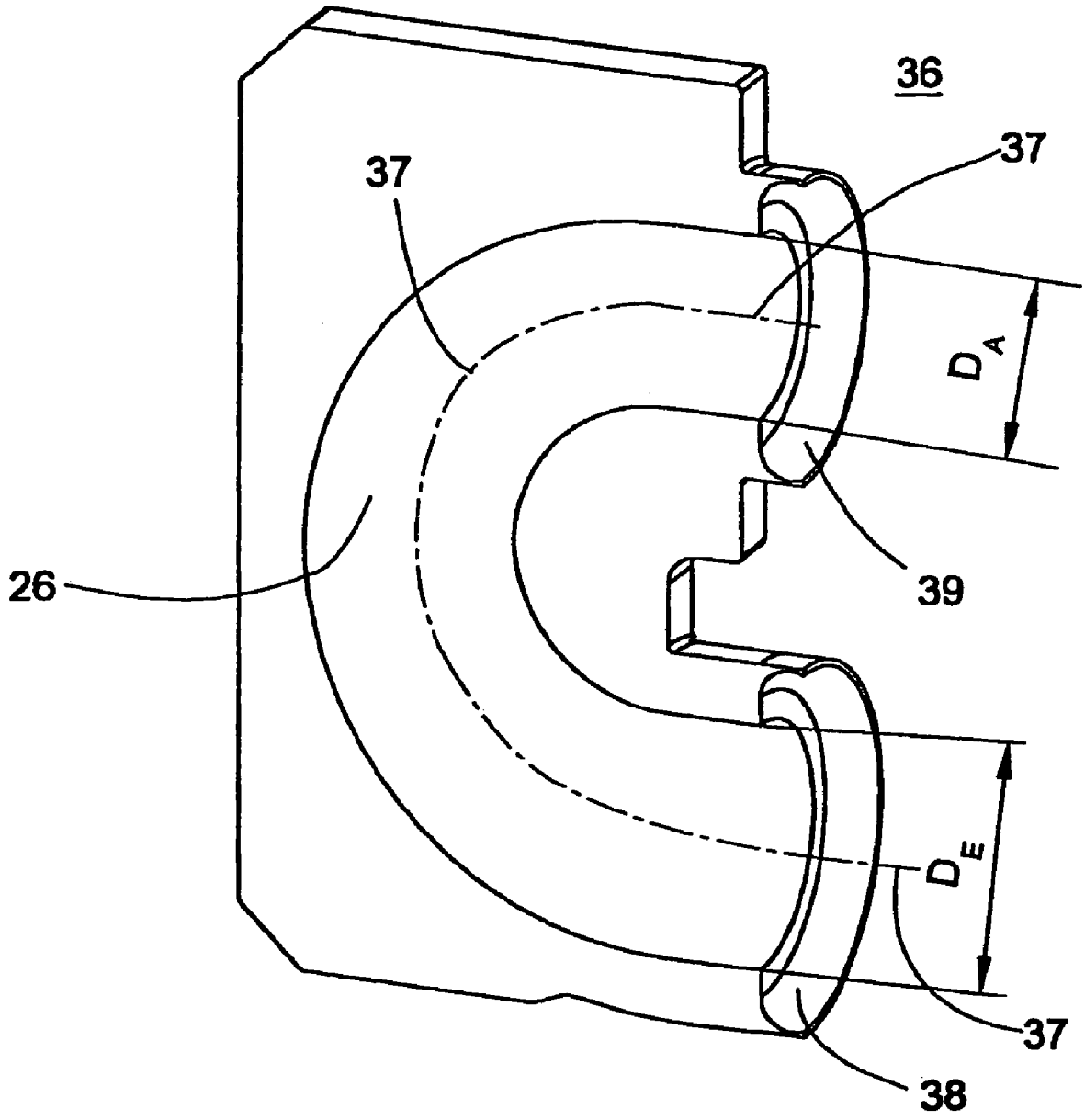
FIG. 3 shows a perspective view of one half of a divided connection element.

FIG. 3 shows a connection element half 36. The interior of the air channel 26 and the recesses 38, 39, into which the sealing rings 30, 31 are placed can easily be seen in the view of FIG. 1. The centre line 37 of the air channel 26 extends linearly at the inlet of the air channel 26, then in a semi-circular manner and again linearly at the outlet of the air channel 26. It can also easily be seen in this view that the air channel diameter $D_E$ at the inlet of the air channel 26 is significantly greater than the air channel diameter $D_A$ at the outlet of the air channel 26.

The connection element half 36 shown and a second connection element half, not shown, and designed in a mirror-inverted manner are joined to form the connection element 27 in such a way that the air channel 26 with a circular cross section is formed. If the connection element half 36 and the second connection element half consist of plastics material, the connection element 27 may be produced from the two components, for example by means of ultrasonic welding. In this manner, simple moulds can be used for the injection moulding process and production becomes more economical.

For threading, the thread, for example, is manually drawn off upwardly from the stationary delivery bobbin and held ready in front of the thread inlet tube. The shut-off mechanism 22 is opened and the compressed air flows from the compressed air source 20 through the compressed air line 21, the feed bore 24 and the transverse bore 25 into the connection element 27 and from there further through the injector bore 32 into the thread channel 17. The air blown in from the injector bore 32 produces an air flow toward the outlet of the thread guide channel 18 and negative pressure in the thread tube 13, which, for example, spreads to the mouth of the thread inlet tube. The end of the thread held ready is sucked by the negative pressure into the thread inlet tube and the thread tube 13, deflected at the deflection element 19 and conveyed further by the air flow through the thread guide channel 18. At the thread guide 29, the thread exits with the air flowing out there and can then be manually grasped by the operator. After the threading process, the shut-off mechanism 22 is activated and the connection between the compressed air source 20 and injector bore 32 is interrupted again.

Owing to the configuration of the two-for-one twisting spindle according to the invention, the air pressure of the compressed air source 20 can be reduced in comparison to a known configuration, as shown in German Patent Publication DE 10250423 A1, for example from 3 bar to 1.7 bar, without the negative pressure, with which the thread is sucked in, becoming less. The air consumption during the threading process can therefore be reduced by 60 to 70%. The lower air consumption leads to increased economy of the two-for-one twisting spindle according to the invention.

What is claimed is:

1. Two-for-one twisting spindle having a pneumatically actuated threading device for a thread, with a spindle shaft which can be rotated about its vertically arranged rotational axis and is partially configured as a hollow shaft and, in the lower part, has a feed bore extending coaxially to the rotational axis, and with an injector element, which opens into a thread guide channel of a thread guide ring and which, during the threading process, can be temporarily connected by means of a compressed air feed to a compressed air source, a part of the compressed air feed to the injector element being formed by the feed bore, characterized in that the compressed air feed comprises a connection element (27) with a curved air channel (26), which connects the feed bore (24) to the injector element (16) and in that the connection element (27) is configured as a separate component and the air channel (26) is adapted to the flow requirements.

2. Two-for-one twisting spindle according to claim 1, characterized in that the air channel (26) has a continuously curved course.

3. Two-for-one twisting spindle according to claim 1 or 2, characterized in that the air channel (26) has a semi-circular course.

4. Two-for-one twisting spindle according to claim 1, characterized in that the air channel (26) has a circular cross section.

5. Two-for-one twisting spindle according to claim 1, characterized in that the air channel (26) has a larger cross section at its inlet than at its outlet.

6. Two-for-one twisting spindle according to claim 5, characterized in that the air channel (26) has a diameter of 4 millimeters at its inlet and a diameter of 3 millimeters at its outlet.

7. Two-for-one twisting spindle according to claim 3, characterized in that the semi-circle, which is described by the air channel (26) with its centre line (37), has a radius of between 3 millimeters and 6 millimeters.

8. Two-for-one twisting spindle according to claim 1, characterized in that the spindle shaft (2) and the thread guide ring (7) have recesses, into which the connection element (27) can be inserted and the angle position of the thread guide ring (7) on the spindle shaft (2) can be adjusted and fixed by the inserted connection element (27).

9. Two-for-one twisting spindle according to claim 1, characterized in that the connection element (27) comprises two components which are rigidly connected to one another and are mirror-inverted with respect to one another.

10. Two-for-one twisting spindle according to claim 1, characterized in that the connection element (27) is produced from glass fiber-reinforced plastics material.

11. Two-for-one twisting spindle according to claim 1, characterized in that a sealing ring, with which the compressed air feed is sealed, is arranged in each case between the connection element (27) and the spindle shaft (2) as well as between the connection element (27) and the injector element (16).

* * * * *